United States Patent [19]

Doner

[11] 4,451,806

[45] May 29, 1984

[54] TUNING MEANS FOR A TRANSMISSON LINE CAVITY

[75] Inventor: Claude E. Doner, New Providence, Pa.

[73] Assignee: RCA Corporation, New York, N.Y.

[21] Appl. No.: 373,664

[22] Filed: Apr. 30, 1982

[51] Int. Cl.[3] ..... H01P 7/04

[52] U.S. Cl. ..... 333/224; 333/207; 333/226; 333/235

[58] Field of Search ..... 333/202, 206–207, 333/222–226, 245, 235; 330/56; 331/101–103

[56] References Cited

U.S. PATENT DOCUMENTS

| | | | |
|---|---|---|---|
| 2,163,625 | 6/1939 | Peterson | 333/206 X |
| 2,240,060 | 4/1941 | Usselman | 333/206 X |
| 2,363,641 | 11/1944 | Carlson | 178/44 |
| 2,435,442 | 3/1948 | Gurewitsch | 178/44 |
| 2,786,945 | 3/1957 | Lyman | 333/231 |
| 2,850,632 | 9/1958 | Lyman et al. | 333/232 |
| 3,273,083 | 9/1966 | Rose | 333/202 X |
| 3,555,465 | 1/1971 | Kuroda et al. | 333/207 |
| 3,820,045 | 6/1974 | Igarashi | 333/185 |
| 3,836,881 | 9/1974 | Koizumi | 336/87 |
| 4,034,320 | 7/1977 | Heckman, Jr. et al. | 333/225 |

FOREIGN PATENT DOCUMENTS 1,026,381 9/1963 Fed. Rep. of Germany.

OTHER PUBLICATIONS

Product Bulletin for RCA 8976 VHF Linear Beam Power Tube, Mar. 1980.

*Primary Examiner*—Marvin L. Nussbaum

*Attorney, Agent, or Firm*—Eugene M. Whitacre; Dennis H. Irlbeck; Vincent J. Coughlin, Jr.

[57] ABSTRACT

A transmission line cavity comprises an outer conductor and a center conductor. The cavity is in combination with a source, such as a power tube, for establishing electromagnetic waves within the cavity. The impedance of the center conductor may be changed, for example by changing the series inductance, to vary the resonant frequency of the cavity.

5 Claims, 8 Drawing Figures

TUNING MEANS FOR A TRANSMISSON LINE CAVITY

BACKGROUND OF THE INVENTION

The invention relates to resonant cavities of the transmission line type, and in particular to means for tuning such resonant cavities.

The design of resonant cavities for low-band VHF-TV service presents a unique problem. The ideal cavity should be of minimum size and weight and should provide the required bandwidth at the highest possible power gain. In the VHF range of 54 to 88 MHz (channel 2 to channel 6), it is very difficult to meet these requirements simultaneously. Size and weight can be minimized by the use of lumped-element type output circuit components, but the gain-bandwidth product and circuit stability are usually compromised due to stray capacitance and parasitic resonances. Coaxial-type output cavities are usually designed to provide a balance between performance and size, usually with some sacrifice of the gain-bandwidth product to prevent the cavity from becoming too large. It has been determined that in a transmission line cavity having a characteristic impedance ($Z_o$) in the range of 85 to 100 ohms and with a center conductor having a diameter of about 7.62 to about 10.16 cm, a cavity length of only about 36 cm is required to achieve tube-circuit resonance at 88 MHz with very low stored energy and nearly optimum gain-bandwidth product. However, in order to tune to 54 MHz at the same impedance, a cavity length of about 81 cm would be required and the gain-bandwidth product would be reduced by about 20 percent over that obtained at 88 MHz.

U.S. Pat. No. 2,435,442 to Gurewitsch issued on Feb. 3, 1948 describes a capacitive tuning arrangement for a concentric transmission line cavity resonator. A capacitive tuning arrangement, however, cannot provide the desired frequency range at a reasonable cavity length.

U.S. Pat. No. 2,363,641 to Carlson issued on Nov. 28, 1944 describes a compact multi-cavity tuner formed by utilizing the otherwise vacant space within a concentric line tuner to accommodate one or more additional series-connected tuning sections. The Carlson structure is primarily an incrementally adjusted cavity wherein frequency can be coursely tuned by the addition of an integral number of additional series-connected tuning sections. A continuous frequency adjustment is provided by a tuned capacitance formed between the end plates of the series-connected tuned sections; however, the tuning range of such tuned capacitance is limited. The structure described in the Carlson patent, while providing a compact tuned cavity, does not provide the means for tuning over the broad range of frequencies required in low-band VHF-TV service while maintaining a cavity of reasonable size and weight.

SUMMARY OF THE INVENTION

A transmission line cavity comprises an outer conductor and a center conductor. The cavity is in combination with an excitation means for establishing electromagnetic waves within the cavity. The center conductor includes variable impedance means for changing the resonant frequency of the cavity. The variable impedance means comprises series inductance modifying means.

DETAILED DESCRIPTION OF THE PREFERRED EMBODIMENT

Figure 1:
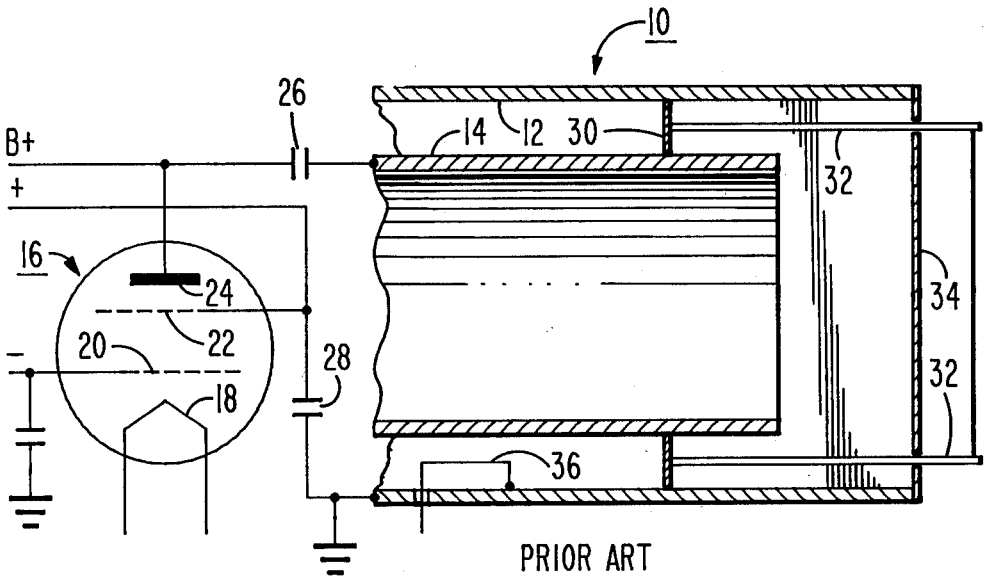
FIG. 1 is a longitudinal sectional view of a conventional transmission line cavity for a high power tetrode.

Referring to FIG. 1, there is shown a very high frequency one-quarter wavelength, coaxial resonant output cavity 10 of the transmission line type comprising a rectangularly-shaped outer conductor 12 having a substantially square cross-section and a centrally disposed tubular inner conductor 14. Electromagnetic waves of the TEM, or transverse electromagnetic type, are established in the region between the conductors 12 and 14 by any suitable excitation means, such as an RCA 8976 VHF Linear Beam Power Tube 16 (available from RCA Corporation, Lancaster, Pa.) or other suitable electron discharge device. The tube 16 is a tetrode having a cathode 18, a control grid 20, a screen grid 22 and an anode 24. The center conductor 14 of the cavity 10 is connected for alternating currents through a plate blocking capacitor 26 to the anode 24. The outer conductor 12 of the cavity 10, preferably, is operated at RF ground potential and is connected through a by-pass capacitor 28 to the screen grid 22 of the tube 16. As herein described, the tube 16 is operated in a cathode drive circuit, although the circuit may be modified to be grid driven. The exact form of the electron discharge device employed for establishing electromagnetic waves between the conductors 12 and 14 forms no part of the present invention and any suitable electron discharge device may be employed for this purpose. In the usual type of such cavities, the electrodes themselves of the tube 16 form a part of the boundary of the resonant cavity 10. The physical length of the cavity 10 can be varied about 22 cm by means of a tuning short 30 disposed between the conductors 12 and 14. The tuning short 30 is affixed to a plurality of control rods 32 which extend from an end 34 of the cavity. Output coupling from the cavity 10 is provided by a coupling means 36 disposed between the conductors 12 and 14. As herein described, the cavity 10 is conventional and the output frequency of the cavity is determined by the length of the cavity. Heretofore, in order to provide a transmission line cavity for use in low-band VHF-TV service, i.e., over the frequency range of 54 MHz to 88 MHz, it was necessary to custom build a cavity of sufficient length for the five TV channels operating within the low VHF band. Such a cavity was not efficient at all frequencies within the low VHF band and, therefore, a tradeoff was required to obtain optimum performance.

Figure 2:
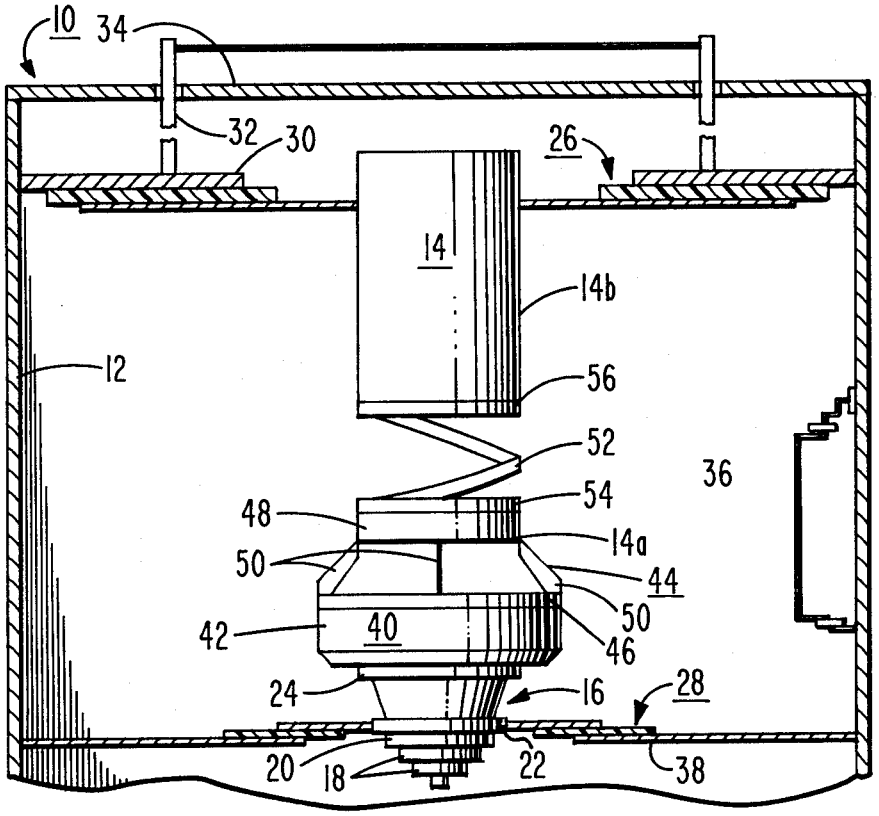
FIG. 2 is a longitudinal sectional view of a transmission line cavity for a high power tetrode showing one embodiment of a novel tuning means.
Figure 3:
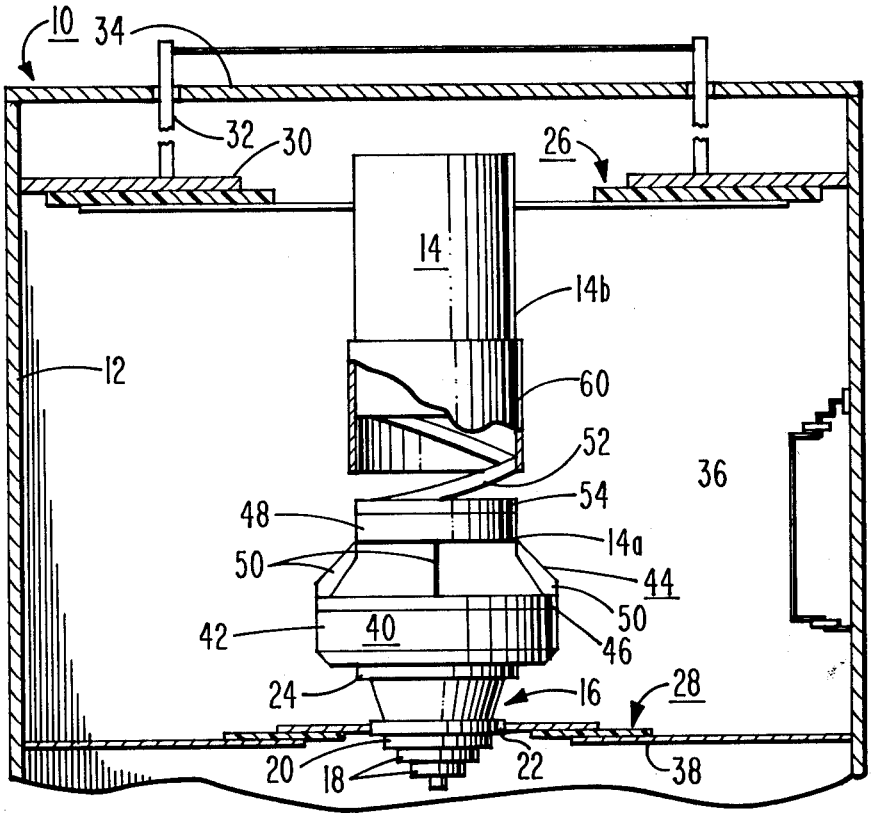
FIG. 3 is a longitudinal sectional view of a transmission line cavity for a high power tetrode showing a second embodiment of a novel tuning means.

With reference to FIGS. 2 and 3, wherein like numbers refer to like elements, an improved transmission line cavity 10 comprises an outer conductor 12 and a novel center conductor 14. The outer conductor 12 has a crosssection of about 43 cm×43 cm. The novel center conductor 14 comprises two hollow portions 14*a* and 14*b* having an inside diameter of about 10 cm. The two portions 14*a* and 14*b* are separated over a length of about 6.35 cm adjacent to the tube 16 by a dielectric material. As shown in FIGS. 2 and 3, the dielectric is an air gap; however, Synthane made by Synthane Taylor, Oaks, Pa., or an equivalent material may be used. The tube 16 is centrally disposed within the cavity 10 with the screen grid 22 in electrical contact, through the by-pass capacitor 28, with a ground plane 38 which is connected to the outer conductor 12. For simplicity, the electrical connections to the tube are not shown; however, the plate capacitor 26 is integral with the tuning short 30. The tube 16 includes a tube radiator 40 comprising a plurality of heat radiating fins (not shown) secured to the external surface of the anode 24. A thin securing cylinder 42 is attached to the outer extremity of the fins. The radiator 40 is adapted to be positioned in a stream of air or other cooling fluid. The radiator 40 is conventional and is described more fully in U.S. Pat. No. 2,951,172 to Griffiths, Jr., et al., issued Aug. 30, 1960 and incorporated herein for the purpose of disclosure. A support spider 44 is attached at one end to the securing cylinder 42 of the radiator 40, and at the other to the first portion 14*a* of the center conductor 14. The spider 44 includes an attachment ring 46 disposed over and in interference fit with a portion of the securing cylinder 42. The other end of the spider 44 comprises a conductor retainer ring 48 which is in intimate electrical contact with the first portion 14*a* of the center conductor 14. A plurality of thin support legs 50 extend between the attachment ring 46 and the retainer ring 48. The support legs 50 are positioned within the upwardly-directed cooling fluid stream and are designed to offer minimum resistance to the stream. Disposed across the air gap which exists between the first portion 14*a* of the center conductor 14 and the second portion 14*b* is a series inductor 52. The inductor 52 may be formed by removing a portion of the center conductor 14 and leaving spiral band or the band may be formed from a discrete conductive strip. Where the inductor 52 comprises a discrete strip, the inductor is secured to the first portion 14*a* of the center conductor by a clamp 54 and to the second portion 14*b* of the center conductor by a second clamp 56. The physical length of the cavity 10 can be varied from about 59 cm with the tuning short 30 fully raised toward the end 34 of the cavity, to about 37 cm with the tuning short 30 adjacent to the clamp 56. The number of turns of the inductor 52 as well as the width of the inductor can be changed to incrementally vary the series inductance of the inductor 52 and, thus, the resonant frequency of the cavity 10.

Figure 4:
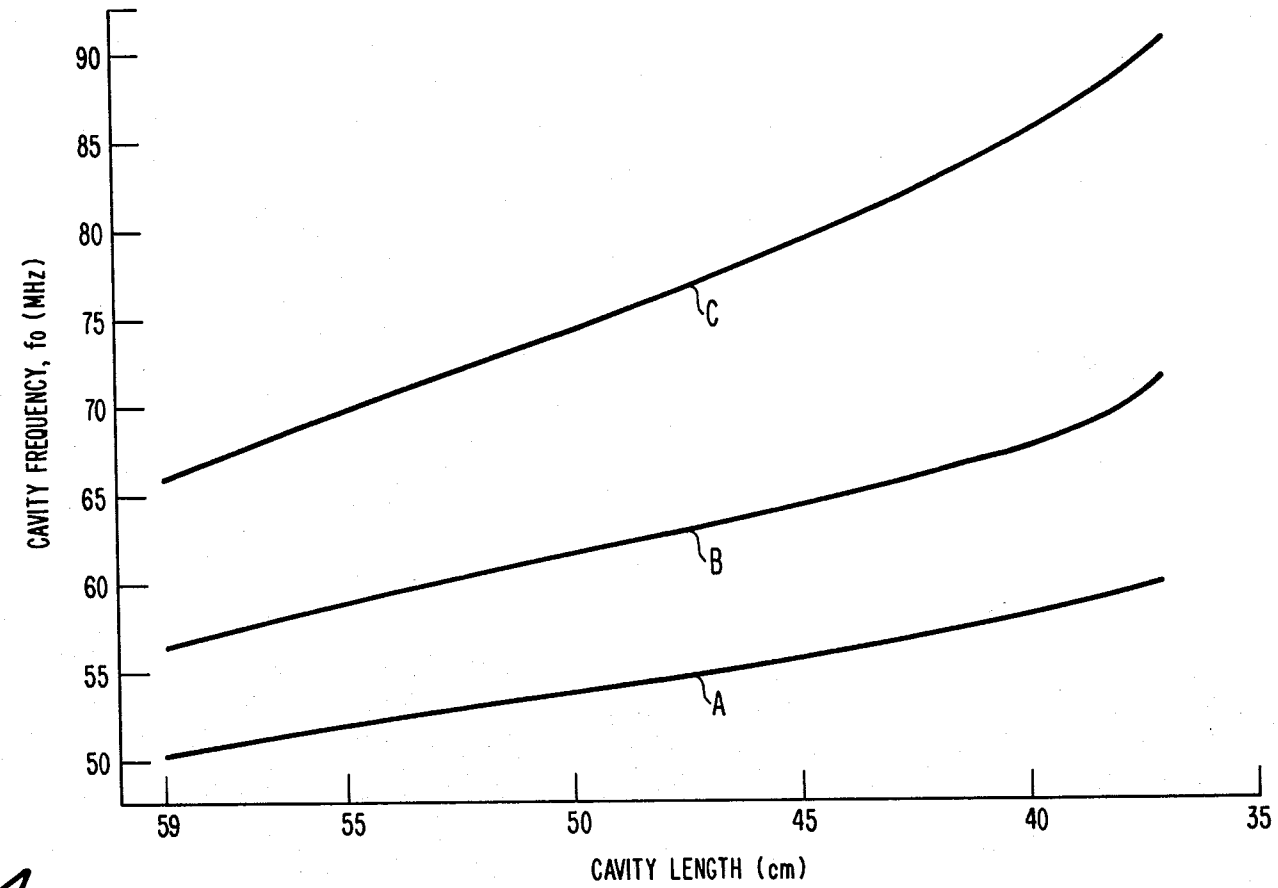
FIG. 4 is a graph of transmission cavity length versus frequency for the embodiments shown in FIGS. 2 and 3.

In addition to incrementally changing the frequency of the cavity 10 as described herein, a conductive cylinder 60, such as that shown in FIG. 3, can be telescopically disposed about, and in sliding contact with the portion 14*b* of the center conductor 14 and with the series inductor 52. The conductive cylinder 60 has a sufficient length to completely bridge the gap between portions 14*a* and 14*b* of the center conductor 14. When fully extended to bridge the gap, a cavity configuration equivalent to the prior art structure shown in FIG. 1 is obtained; however, the telescopic conductive cylinder 60 provides a means for continuously varying the series inductance 52. Curves A and B of FIG. 4 show the variation in cavity frequencies as a function of cavity length for a center conductor 14 having one turn inductors of widths 1.27 cm and 2.54 cm, respectively, briding an air gap having a length of about 6.35 cm. Curve C of FIG. 4 shows the frequency range for the structure of FIG. 3 in which the conductive cylinder 60 completely bridges the gap between portions 14*a* and 14*b* of the center conductor 14. By varying the series inductance of the center conductor 14 and the length of the cavity by means of the tuning short 30, the frequency of the cavity 10 can be varied between about 50 to 90 MHz.

Figure 5:
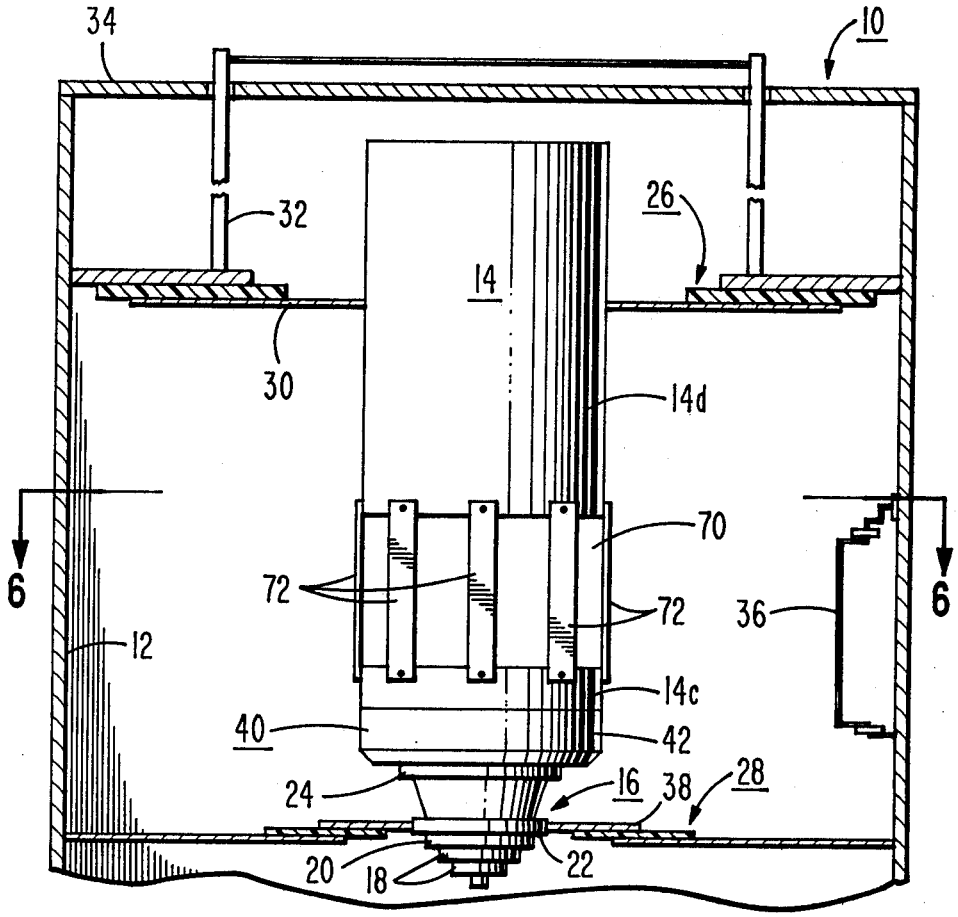
FIG. 5 is a longitudinal sectional view of a transmission line cavity for a high power tetrode showing a third embodiment of a novel tuning means.
Figure 6:
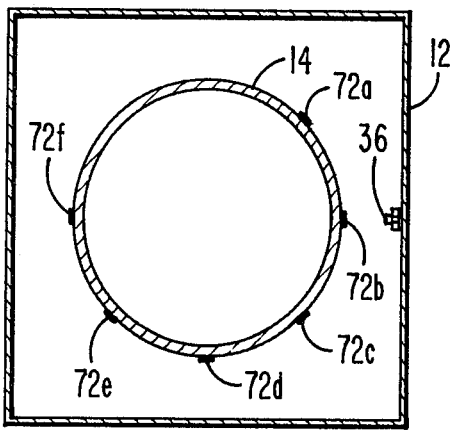
FIG. 6 is a sectional view along line 6—6 of FIG. 5.

Another embodiment of the novel center conductor 14 comprising a hollow Synthane cylinder 70 disposed between a first portion 14*c* and a second portion 14*d* of the center conductor is shown in FIG. 5. First portion 14*c* of the center conductor 14 is diposed over and attached to the securing cylinder 42 of tube radiator 40. Both portions of the center conductor 14 have an inside diameter of about 21 cm which is substantially equal to the outside diameter of the securing cylinder 42 of the tube radiator 40. A plurality of longitudinally-disposed straps 72 are detachably attached at one end to the first portion 14*c* of the center conductor and at the other end to the second portion 14*d* of the center conductor. By varying the number and the location of the straps, while keeping the strap size and cavity length constant, a wide frequency range can be obtained. In Table I, the cavity length is fixed at about 47 cm, the coupling means 36 is located as shown in FIGS. 5 and 6, the width of the straps 72 is 1.9 cm, the angular spacing, center-to-center, of adjacent strap locations is 45°, and the height of the Synthane cylinder 70 is about 18 cm. The straps are oriented at one or more of the locations shown in FIG. 6; however, it should be noted that while six strap locations 72*a* through 72*f* are shown in FIG. 6, a maximum of only four straps are actually used at any time.

TABLE I

| STRAP(s) LOCATION | CAVITY FREQUENCY (MHz) |
|---|---|
| 72b | 54.00 |
| 72a, 72b | 66.71 |
| 72a, 72b, 72c | 75.72 |
| 72a, 72b, 72c, 72d | 83.59 |
| 72a, 72b, 72c, 72e | 86.34 |
| 72a, 72b, 72c, 72f | 87.20 |

With a single strap 72 positioned at location 72*b*, the resonant frequency of the cavity 10 was 54.00 MHz. As additional straps 72 are added in the positions indicated in Table I and shown in FIG. 6, the resonant frequency of the cavity 10 increases. With three straps 72 disposed at positions 72*a*, 72*b* and 72*c*, the frequency of the cavity 10 is 75.72 MHz. Notice in Table I that with four straps affixed between the first and second portions 14*c* and 14*d* of the center conductor 14, the frequency is dependent on the location of the straps 72 relative to one another and to the outer conductor 12. In the above structure, the resonant frequency of the cavity is incrementally varied by changing the characteristic impedance of the output circuit which is accomplished by adding or deleting the straps 72 in the manner described above. The number and location of the straps 72 change both the series inductance and shunt capacitance of the cavity 10.

Figure 7:
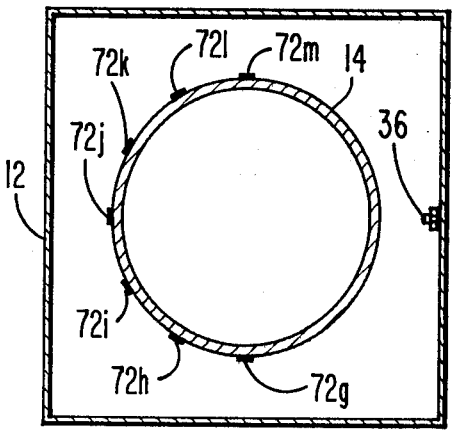
FIG. 7 is a top sectional view of a transmission line cavity for a high power tetrode showing an alternative embodiment to that depicted in FIG. 6.

FIG. 7 shows another embodiment of the present invention. In this embodiment, the width of the longitudinally-extending, detachably-attached straps 72, the height of the Synthane cylinder 70, and the diameter of the center cylinder 14 are unchanged from the embodiment described herein with respect to FIGS. 5 and 6; however, the angular spacing, center-to-center, between adjacent strap locations is decreased to 30°. In this embodiment, seven strap locations 72*g* through 72*m* are provided. As shown in Table II, the cavity length is varied for each strap configuration evaluated. The results of Table II are graphically presented in FIG. 8 in which the resonant frequency in MHz of the cavity 10 is plotted on the ordinate, the cavity length in centimeters is plotted along the abscissa and curves D through J represent the number and location of the longitudinal straps 72 as described in Table II. Curve K is provided for comparison purposes and shows the change in frequency with the change in cavity length for a prior art center conductor 14 having an inside diameter of about 21 cm but without the novel variable impedance means of the present invention.

TABLE II

| STRAP(s) LOCATION | CURVE | CAVITY LENGTH (cm) | CAVITY FREQUENCY (MHz) |
|---|---|---|---|
| 72j | D | 59.18 | 58.70 |
| | | 51.82 | 60.63 |
| | | 46.48 | 62.05 |
| | | 41.66 | 63.73 |
| 72j & 72k or 72i & 72j | E | 59.18 | 66.55 |
| | | 54.36 | 68.48 |
| | | 46.48 | 71.74 |
| | | 41.66 | 74.34 |
| 72i, 72j, 72k | F | 59.18 | 71.75 |
| | | 54.36 | 74.23 |
| | | 46.48 | 78.66 |
| | | 41.66 | 81.85 |
| 72h through 72k or 72i through 72l | G | 59.18 | 75.74 |
| | | 43.69 | 86.00 |
| | | 41.66 | 88.02 |
| 72h through 72l | H | 59.18 | 79.15 |
| | | 47.50 | 88.01 |
| | | 44.20 | 91.24 |
| 72h through 72m or 72g through 72l | I | 59.18 | 81.99 |
| | | 51.82 | 88.17 |
| | | 44.20 | 95.89 |
| 72g through 72m | J | 59.18 | 84.22 |
| | | 54.61 | 88.18 |
| | | 44.20 | 99.63 |

With reference to Table II, when an even number of straps 72 are disposed in the strap locations such as in locations 72*i* and 72*j* or in locations 72*j* and 72*k*, the cavity frequencies for a given cavity length are identical since the sets of strap locations are symmetrical in relation to the outer conductor 12. It should be apparent to one skilled in the art that the strap location, spacing between adjacent straps and the number of straps may be varied with respect to the coupling means 36 to achieve the desired cavity frequency and optimum coupling characteristics.

Figure 8:
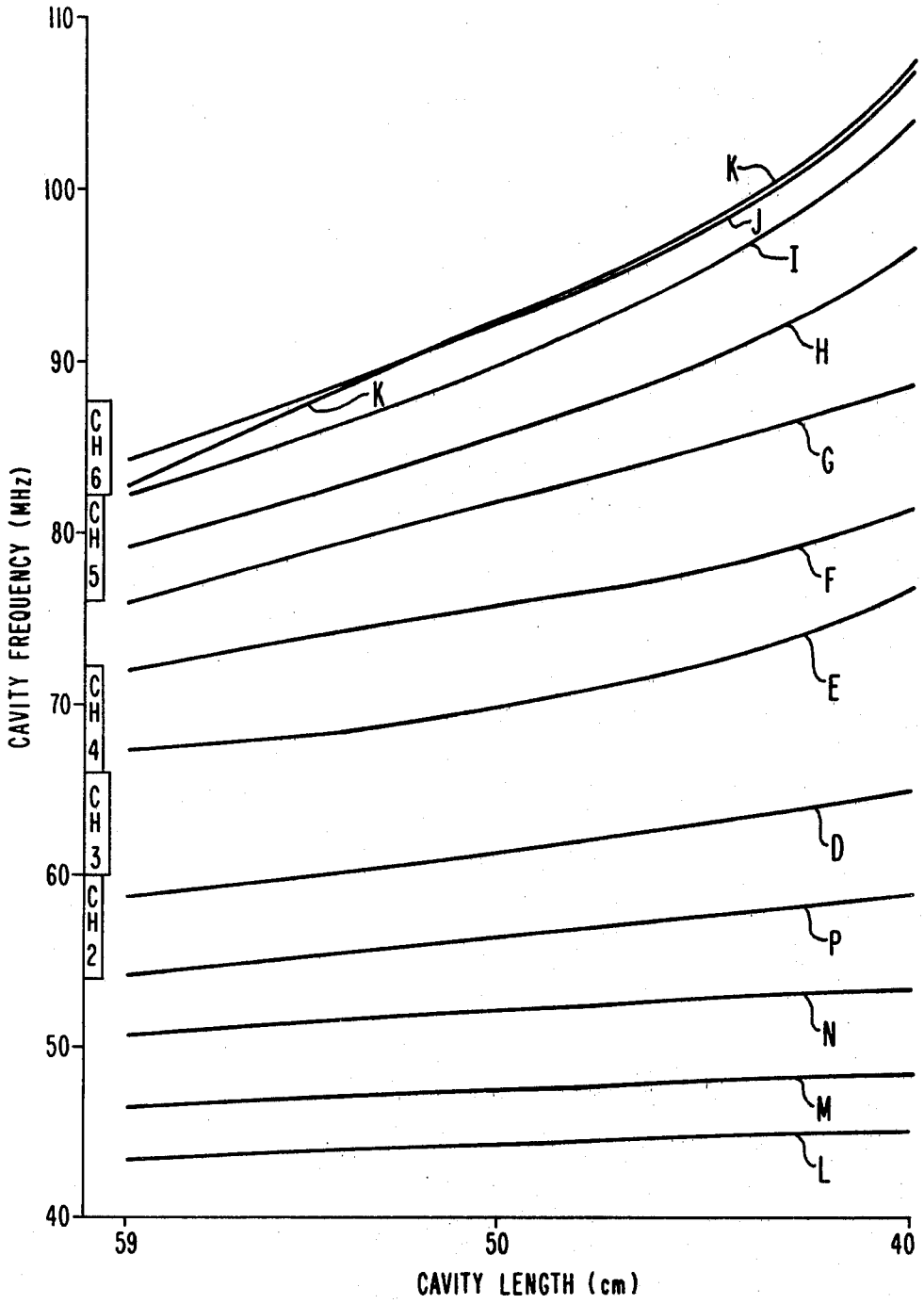
FIG. 8 is a graph of transmission cavity length versus frequency for various embodiments of the novel tuning means having a center conductor inside diameter substantially equal to the outside diameter of the tube shown in FIG. 5.

An additional series of tests were performed in which the detachably-attached, longitudinally-extending straps 72 were removed from across the Synthane cylinder 70 shown in FIG. 5 and replaced with detachably-attached straps formed as coils spiralled partially around the Synthane member. As shown in FIG. 8, curve L represents the range of the cavity frequencies for a 1.6 cm wide spiral strap disposed between portions 14*c* and 14*d* of the center conductor 14 and extending for a full 360° turn around the Synthane cylinder 70 over a cavity 10 varying in length from about 59 to about 40 cm. Curve M shows the range of cavity frequencies for a spiral strap identical in width to that of curve L but extending 270° around the Synthane cylinder 70, while curve N represents the cavity frequencies for a strap identical in width to that of curves L and M but extending about 180° around the cylinder 70 over the cavity lengths shown in FIG. 8. Curve P shows the cavity frequencies for a strap having a width of about 1.9 cm and extending about 90° around the cylinder 70.

From curves L through P of FIG. 8, it can be seen that the cavity frequencies for the various spiralled strap configurations decrease as the strap length approaches one full turn.

The embodiments described herein are not exhaustive of the possible variations in center conductor diameter, strap length and width, or number of turns that can be changed to provide a modification in the series inductance of the center conductor. It should be clear to one skilled in the art, that based on the teachings contained herein, the resonant frequency of a transmission line cavity may be varied by changing any one or any combination of the cavity parameters either sequentially or simultaneously.

What is claimed is:

1. In a transmission line cavity comprising an outer conductor and a hollow cylindrical center conductor, said cavity being in combination with an excitation means for establishing electromagnetic waves within said cavity, the improvement wherein said center conductor has a discontinuity therein, said discontinuity being bridged by at least one discrete conductive member to provide an incrementally variable series inductance for changing the resonant frequency of said cavity and to provide a current carrying path along said center conductor.

2. The transmission line cavity as in claim 1 wherein said discrete conductive member may be detachably-attached across said discontinuity in said center conductor to thereby incrementally change the series inductance of said cavity.

3. The transmission line cavity as in claim 2 wherein said discrete conductive members comprise spiral members.

4. In a transmission line cavity comprising an outer conductor and a hollow cylindrical center conductor, said cavity being in combination with an excitation means for establishing electromagnetic waves within said cavity, the improvement wherein said center conductor has a discontinuity therein, said discontinuity being bridged by at least one discrete conductive spiral member which is detachably-attached across said discontinuity to provide an incrementally variable series inductance for changing the resonant frequency of the cavity and to provide a current carrying path along said center conductor.

5. In a transmission line cavity comprising an outer conductor and a hollow cylindrical center conductor, said cavity being in combination with a power tube for establishing electromagnetic waves within said cavity, said tube having at least one grid and an anode, said outer conductor being electrically connected to said grid and said center conductor being electrically connected to said anode, the improvement wherein said center conductor comprising a first portion secured to said anode and a second portion spaced from said first portion, at least one discrete conductive member being secured between said first and second portions of said center conductor, the location and number of members providing means for incrementally varying the series inductance and resonant frequency of said cavity.

* * * * *